US007061352B2

(12) United States Patent
Lin

(10) Patent No.: US 7,061,352 B2
(45) Date of Patent: Jun. 13, 2006

(54) NOISE-FREE LOW-POWER CONSUMPTION WIDE VOLTAGE RANGE DC AND AC CONTACTOR AND REMOTE TELEPHONE CONTROL SYSTEM USING THE SAME

(76) Inventor: Tzo-Ing Lin, No. 18, Mei Hsing Street, Mei Lung Chen, Kaohsiung Hsien (TW)

( * ) Notice: Subject to any disclaimer, the term of this patent is extended or adjusted under 35 U.S.C. 154(b) by 130 days.

(21) Appl. No.: 10/763,323

(22) Filed: Jan. 26, 2004

(65) Prior Publication Data

US 2005/0162246 A1 Jul. 28, 2005

(51) Int. Cl.
*H01H 67/02* (2006.01)

(52) U.S. Cl. ..... 335/108; 335/132; 335/113

(58) Field of Classification Search ..... 335/131–132, 335/106, 108, 113
See application file for complete search history.

(56) References Cited

U.S. PATENT DOCUMENTS 2,331,514 A * 10/1943 Stibitz ..... 335/108
4,292,611 A * 9/1981 Bresson et al. ..... 335/6
6,911,884 B1 * 6/2005 Uotome et al. ..... 335/132
2003/0016105 A1 * 1/2003 Bauer et al. ..... 335/132

* cited by examiner

*Primary Examiner*—Lincoln Donovan
(74) *Attorney, Agent, or Firm*—Rosenberg, Klein & Lee

(57) ABSTRACT

A noise-free low-power consumption wide voltage range DC and AC contactor and remote telephone control system is disclosed. A movable iron core is connected to a linkage. Another end of the linkage is connected to a micro switch. A normal close contact of the micro switch is serially connected to a magnetic coil and is parallel connected to an IC circuit and a retaining coil. A lower end of the movable iron coil is in the extent of the coil so that the magnetic coil attracts the movable iron core to move downwards to conduct the contactor and meanwhile, the magnetic coil will disconnect. The retaining coil is used to replaced the magnetic coil to attract the movable iron core. Since the power consumption of the retaining coil is small and thus the contactor is noise free, lower power consumption, and wide voltage range. Three voltage stages are selectable. The connector can be used with a telephone, a telephone wire, a voice system, a keyboard and a software program so as to be formed as a remote telephone control system with a simple structure, lower cost and be a multi-functional device. Thereby, it can be used widely.

5 Claims, 5 Drawing Sheets

NOISE-FREE LOW-POWER CONSUMPTION WIDE VOLTAGE RANGE DC AND AC CONTACTOR AND REMOTE TELEPHONE CONTROL SYSTEM USING THE SAME

FIELD OF THE INVENTION

The present invention relates to electric contactors, and particular to a noise-free low-power consumption wide voltage range dc and ac contactor and remote telephone control system using the same, which can be used to a remote telephone control system comprising a telephone, a keyboard, a software program, and a voice system.

BACKGROUND OF THE INVENTION

In the prior art communication contactors, the magnetic coils are used to attract an iron coil and preventing it from being ejected back during the usage of the communication contactor. The magnetic coil must be kept in actuation, thereby causing the magnetic coil to make noise due to continuous actuation. This prior art consumes larger electric power, meanwhile operating cost is increased. Noise not only makes the background too noisy but also shortens the lifetime of the contactor.

Due to the large bulk of communication contactor with high cost and large noise, if it is desired to make a noiseless contactor, the volume will become larger and wires are more and more complicated. Thereby, remote telephone control systems using the prior arts are not used widely.

Thereby, the prior art contactor still has many drawbacks and is not a preferred design. Thereby, it is necessary to be improved.

For improving the above said defects, the inventor of the present invention has create a new design which can improve the prior art defects.

SUMMARY OF THE INVENTION

Accordingly, the primary object of the present invention is to provide a noise-free low-power consumption wide voltage range dc and ac contactor and remote telephone control system using the same, wherein an iron coil is attracted and a retaining coil is used to replace a magnetic coil. Thereby, noise can be reduced and power consumption is also reduced. The magnetic coil is worked in a short time and work transiently. The voltage used is wide, which includes the following three ranges:

1. A first band is from2V~120V which is commonly for DC and AC, including DC/AC voltage of 2V, 4V, 6V, 8V, 9V, 12V, 24V, 48V, 65V, 80V, 100V, 110V, 120V, etc.
2. A second band is from 100V to 250V which is commonly for DC and AC, including DC/AC of 100V, 110, 120V, 200V, 220V, 240V, 250V, etc.
3. A third band is from 200V to 480V which is commonly for DC/AC, including DC and AC of 200V, 220V, 240V, 250V, 275V, 380V, 415V, 440, 480V.

The present invention can be used widely with a range from 0.1 A to 2000 A DC or AC contactor. Moreover, the present invention is simple, lower noise, lower power consumption, lower cost with a small volume.

To achieve above object, the present invention provides a noise-free low-power consumption wide voltage range DC and AC contactor comprising: a housing; an static iron core installed on an inner bottom of the housing; an movable copper installed in an inner top of the housing; each of two ends of the movable copper having a respective movable silver spot; static silver spots being installed below the movable silver spots; two stationary coppers connected to a wall of the housing; each of the stationary coppers being installed with a respective one of the static silver spots; a middle part of the movable copper being connected to a movable iron core; a spring installed between a bottom of the moveable iron core and an inner bottom of the static iron core on the housing; a magnetic coil wound around one leg of the static iron core; a retaining coil wound around another leg of the static iron core; characteristic in that a linkage having one end connected to the moveable iron core; a micro switch connected to another end of the linkage; the micro switch being connected to the magnetic coil, an integrated circuit and the retaining coil; wherein the bottom of the moveable iron core is within longitudinal extents of the magnetic coil and retaining coil.

The connector can be used with a telephone, a telephone wire, a voice system, a keyboard and a software program so as to be formed as a remote telephone control system with a simple structure, lower cost and be a multi-functional device. Thereby, it can be used widely.

DETAIL DESCRIPTION OF THE INVENTION

Figure 1:
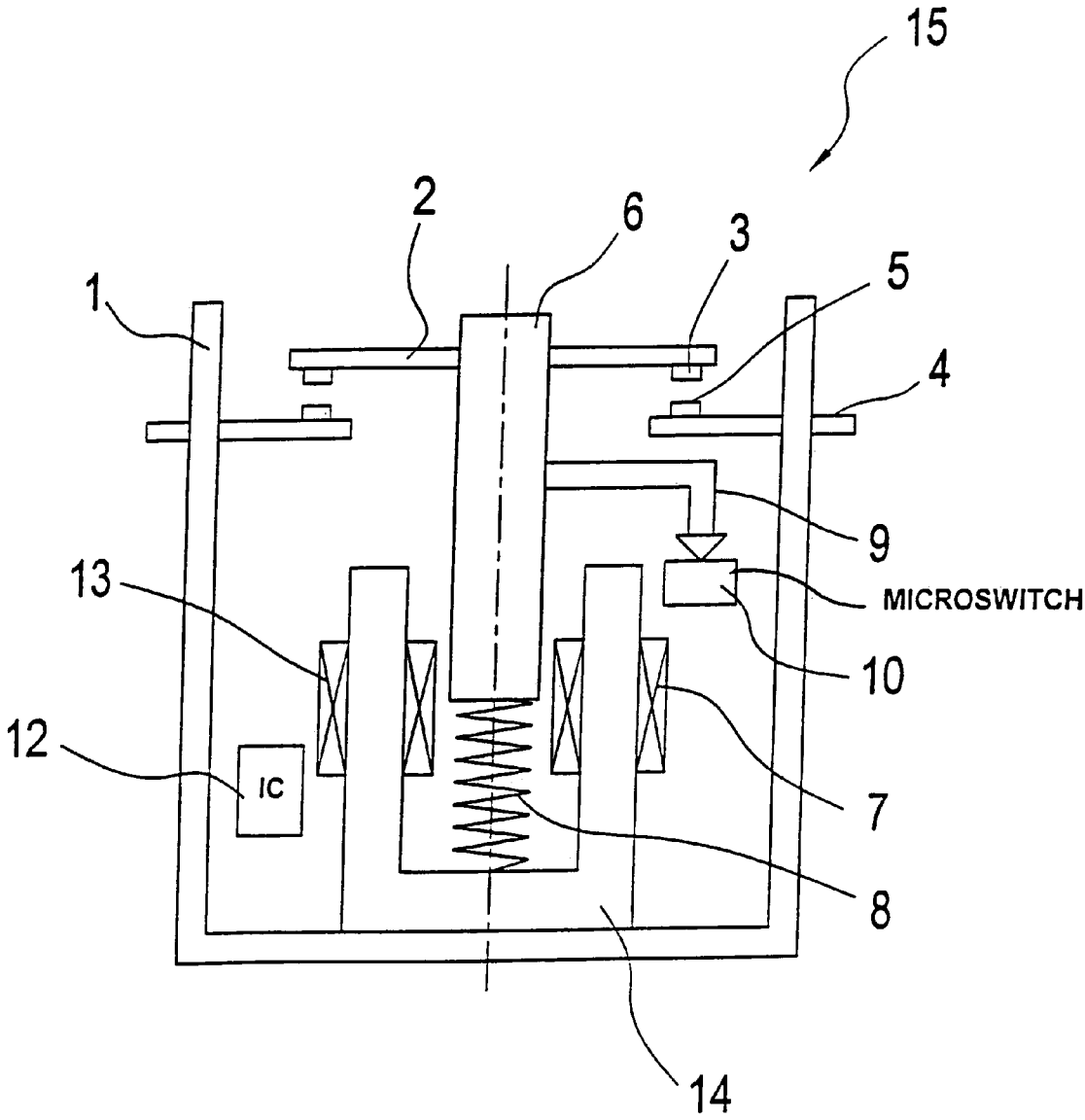
FIG. 1 is a schematic view showing the noise-free low-power consumption wide voltage range dc and ac contactor of the present invention.
Figure 2:
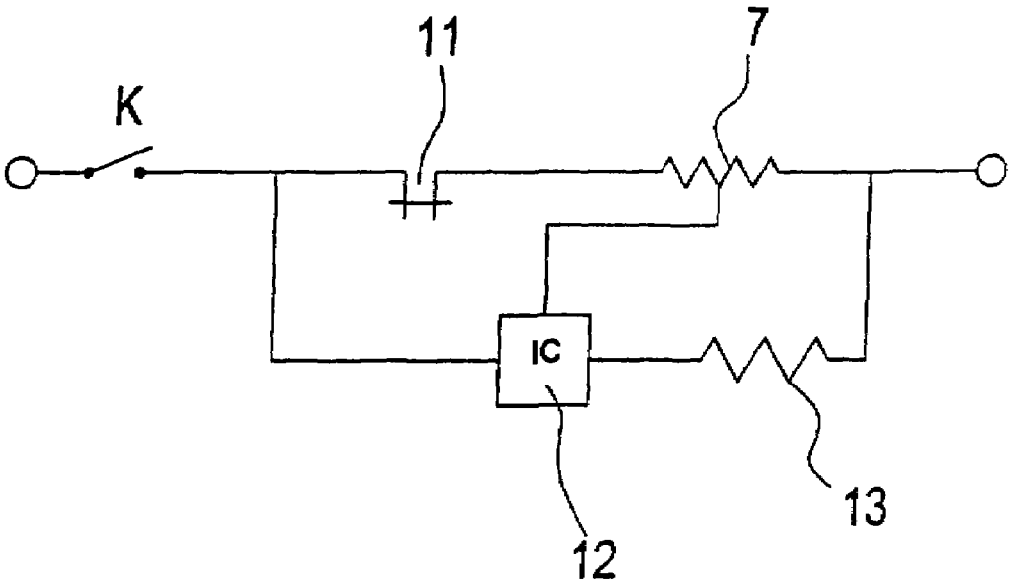
FIG. 2 is a circuit diagram of the magnetic coils, retaining coil and IC circuit of the noise-free low-power consumption wide voltage range dc and ac contactor of the present invention.
Figure 3:
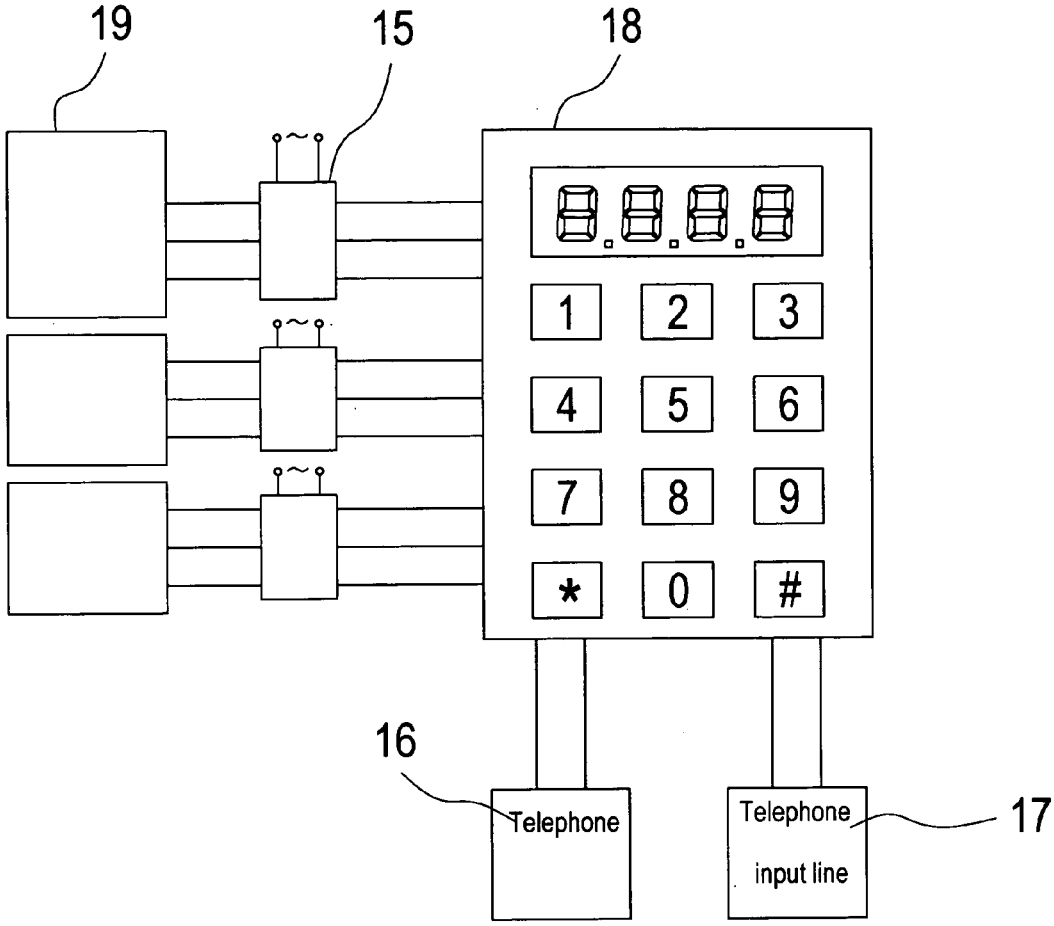
FIG. 3 shows the structure of the noise-free low-power consumption wide voltage range dc of the present invention.

As shown in FIGS. 1 and 2, the structural schematic view of noise-free low-power consumption wide voltage range dc and ac contactor of the present invention and the circuit connection of the magnetic coils and retaining coils and IC circuit of the present invention are illustrated. It is shown that the voltage control communication contactor includes a housing 1. A static iron core 14 is located at the inner bottom of the housing 1. A movable copper 2 is installed at the inner top of housing 1. The two ends of the movable copper 2 are installed respective movable silver spots 3. Two stationary coppers 4 are connected to the housing 1. Each of the stationary coppers 4 is installed with a respective static silver spot 5. The static silver spot 5 is directly faced to the respective bottoms of active silvers spots 3. Middle ends of movable coppers 2 are connected to an moveable iron core 6. The bottom of moveable iron core 6 is within the range of magnetic coil 7. A spring 8 is installed between a bottom of the moveable iron core 6 and an inner bottom of the static iron core 14 on housing 1. In the present invention, a linkage 9 has one end being connected to the moveable iron core 6; and another end of the linkage 9 is connected with a micro switch 10. The micro switch 10 has a normally closed contact point 11. The contact point 11 is serially connected to the magnetic coil 7. Signals are transferred from the magnetic coil 7 to an IC circuit (integrated circuit) 12. The IC circuit 12 is connected to a retaining coil 13. The contact point 11 and magnetic coil 7 are coupled to the circuit 12 and retaining coil 13. The retaining coil 13 is near the inner bottom the housing 1. The bottom of moveable iron core 6 is kept within the range of the retaining coil 13 because the magnetic coil 7 has been attracted by the moveable iron core 6. Therefore the retaining coil 13 can be placed under the magnetic coil 7. Above said components constructs the noise-free low-power consumption wide voltage range dc and ac contactor 15 of the present invention, as shown in FIG. 3.

Before the actuation of the contactor 15, as shown in FIG. 1, the magnetic coil 7 has a current flowing therethrough. The moveable iron core 6 is not attracted, and the movable silver spot 3 is disconnected from the static silver spot 5. Therefore, the contactor is inoperable. When the contactor 15 is actuated, as shown in FIGS. 1 and 2, the magnetic coil 7 is induced as switch K closes. It then attracts the moveable iron core 6 so as to compress the spring 8. The movable copper 2 moves downwards and the movable silver spots 3 are connected to the static silver spots 5 on stationary coppers 4. The circuit is conductive and the contactor 15 works. As the moment that the contact point of each movable silver spot 3 is in contact with the static silver spots 5, the linkage 9 from the moveable iron core 6 moves downward to be connected to the micro switch 10. Thereby, the contact point 11 will disconnect magnetic coil 7, and thus the magnetic coil 7 does not conduct. The signals generated from the magnetic coil 7 which is now non-conducted is transferred to the retaining coil 13 through the IC circuit 12 so as to keep the conduction of the retaining coil 13. Since when the moveable iron core 6 is kept within the extent of the retaining coil 13, the coil 13 can grip moveable iron core 6 no matter how small the power is. Thereby, the spring 8 cannot resilient. The contactor 15 keeps in actuation.

Since the retaining coil 13 is designed to have fewer coils, a smaller diameter, lower power than those of the magnetic coil 7, in order that the magnetic coil 7 could attract the moveable iron core 6, it is necessary to consume more power. If the coil 7 still attracts after the moveable iron core 6 is attracted, then large noise and power generates. Therefore it is only necessary to keep the retaining coil 13 in actuation for replacing the magnetic coil to eliminate noise and keep the power down.

If the whole contactor 15 short circuits outsides, this will keep the retaining coil 13 and magnetic coil 7 from working. Moveable iron core 6 will be ejected upwards from the spring 8. Contactor 15 will not work until the outside is powered to repeat the above steps.

If the IC circuit 12 receives negative pulse signals as the magnetic coil 7 interrupts from conduction and then to cause the keep coil 13 work. Since it is connected to magnetic coil 7 in parallel, the original circuit is still connected, contactor 15 still works.

Figure 4:
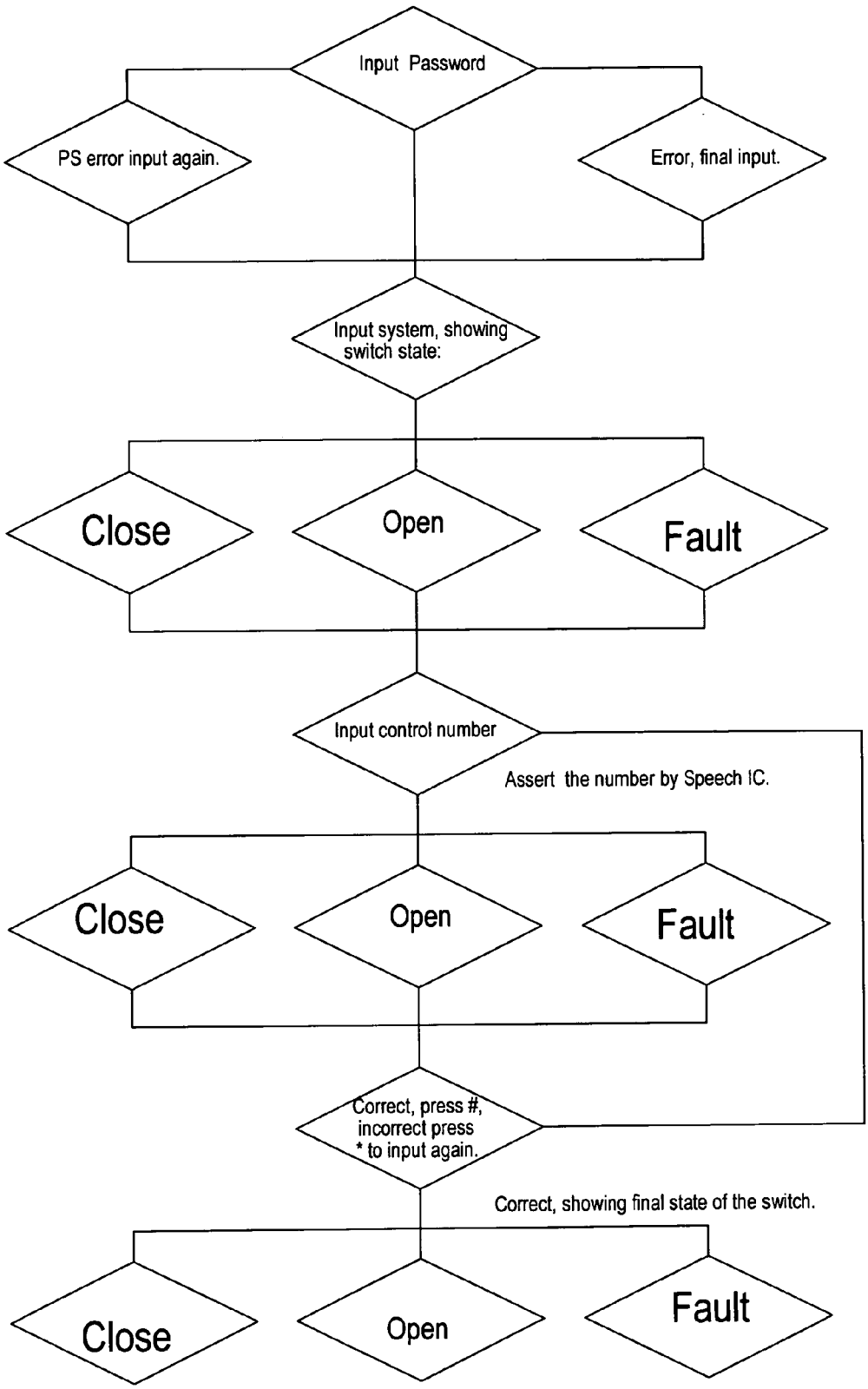
FIG. 4 is a flow diagram about the processing of the noise-free low-power consumption wide voltage range dc and ac contactor of the present invention.
Figure 5:
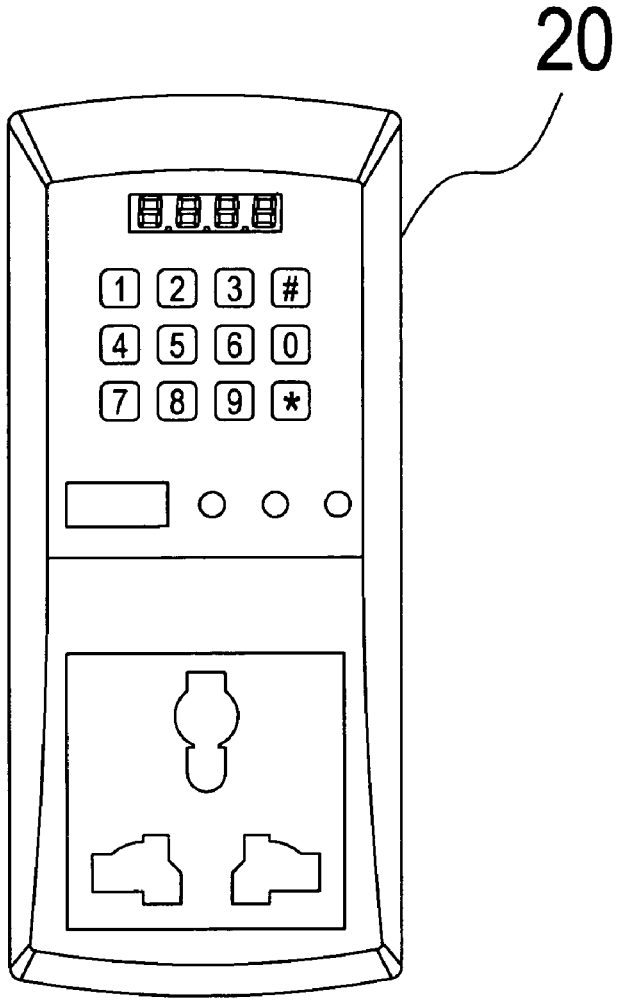
FIG. 5 shows the outer appearance of the remote telephone control system using the noise-free low-power consumption wide voltage range dc and ac contactor of the present invention.

As shown in FIGS. 3, 4, and 5, a remote telephone control system using the noise-free low-power consumption wide voltage range dc and ac contactor of the present invention is illustrated. The remote telephone control system using the same is formed by a plurality of contactors 15, an input telephone wire 17, a voice system, and a keyboard 18. The remote telephone control system serves to control an electric device 19. The telephone input wire 17 extending from the telephone 16 is connected to a voice system and the keyboard 18. Software process stored in the voice system and the keyboard 18 output of which is transferred to a respective contactor 15. One end of the contactor 15 is connected to an external power and another end thereof is connected the electric device 19, i.e. a terminal customer.

As shown in FIG. 4, the signal process about the application of the contactor 15 of the present invention is illustrated. When the telephone 16 receives signals, the process is performed according to steps illustrated in FIG. 4. If it is necessary to remotely control the electric device 19, a password is entered. Then the process illustrated in FIG. 4 is performed step by step. It on means to connect the voice system(as switch K is closed in FIG. 2). After the moveable iron core 6 is induced and moves downward, the movable silver spots 3 are in contact with the static silver spots 5. External current will flow through the stationary copper 4 to conduct to the electric device 19. Thereby, a far distance electric device 19 can be remotely controlled by a telephone. Meanwhile the linkage 9 of the moveable downward with the movement of the so as to actuate the micro switch 10 with the moveable iron core 6 separating from the common contact point 11 of the magnetic coil 7. The magnetic coil 7 disconnects so that signals are collected and transfer to IC circuit 12 and then to circuit 13 so as to replace the function of the magnetic coil 7 to overcome the pressure from the upward resilient force of the spring 8. Thus, the moveable iron core 6 is still induced. If it is desired to turn off the electric device 19, the software will process it as well. The last step will be from voice system and keyboard 18 to output to the contactor 15 and then to the magnetic coil 7 (as switch K disconnects in FIG. 2). The moveable iron core 6 will move upwards by the resilient force of the spring 8, causing movable silver spots 3 to disconnect from static silver spots 5. The contactor 15 is not in operation, and no electric devices 19 is actuated.

If a plurality of electric devices 19 are desired to be controlled, it is only necessary to increase the number of contactors. Thereby, various electric devices can be controlled.

The noise-free low-power consumption wide voltage range dc and ac contactor of the present invention can be combined to a remote telephone control system (receiving portion) so as to be formed as a control device 20, as shown in FIG. 5. Thereby, it can be inserted into an external device and then the telephone input wire is connected so as to conduct with a telephone wire. Thus, the object of control is achieved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A noise-free low-power consumption wide voltage range DC and AC contactor, comprising:

a housing including a bottom, a top, and at least a pair of opposite walls extending between said bottom and said top of said housing;

a static iron core installed at said bottom of the housing, said static iron core having a longitudinal axis thereof and including a first core leg and a second core leg displaced from said first core leg relative said longitudinal axis;

a movable iron core having a fist end and a second end and installed in said housing and reciprocating along said longitudinal axis of said static iron core;

a movable copper having two ends and a middle portion, said middle portion being attached to said first end of said movable iron core in proximity to the top of the housing, said movable copper having a movable silver spot disposed on each of said two ends of said movable copper;

a stationary copper attached to each wall of said pair of opposite walls of the housing, each said stationary copper having a static silver spot formed thereon, said static silver spot being disposed below said moving silver spot;

a spring installed between said second end of the moveable iron core and a bottom of the static iron core along said longitudinal axis thereof;

a magnetic coil wound around said first core leg of the static iron core;

a retaining coil wound around said second core leg of the static iron core, axes of said magnetic coil and said retaining coil being displaced each from the other relative said longitudinal axis of said static iron core;

an integrated circuit coupled between said magnetic and retaining coils;

a micro switch operatively coupled to the magnetic coil, said microswitch including a normally closed contact point connected in series with the magnetic coil; and a linkage member having one end and another end and connected by said one end thereof to said movable iron core, said linkage member controlling said microswitch, wherein, when said moveable iron core is attracted towards said bottom of the housing into said static iron core between said magnetic coil and said retaining coil and when respective ones of said movable and static silver spots are brought in contiguous engagement said linkage mechanism engages by said another end thereof said microswitch and opens said normally closed contact point of said microswitch, thereby ceasing the energizing of said magnetic coil and starting energizing said retaining coil through said integrated circuit.

2. The noise-free low-power consumption wide voltage range DC and AC contactor as claimed in claim 1, wherein the integrated circuit is connected in parallel to the retaining coil, and wherein said magnetic coil and said retaining coil are coupled in parallel.

3. The noise-free low-power consumption wide voltage range DC and AC contactor as claimed in claim 1, further including at least one electrical device to be controlled and a telephone system comprising a keyboard, a software program, a telephone input wire, and a voice system, at least one said contactor being coupled between said at least one electrical device to be controlled and said telephone system, thereby forming a remote telephone control system.

4. The noise-free low-power consumption wide voltage range DC and AC contactor as claimed in claim 1, wherein at least one said contactor is combined with a remote telephone control system having a telephone wire to form a control device to control an object of control; the control device being connected to a power supply through the telephone wire.

5. The noise-free low-power consumption wide voltage range DC and AC contactor as claimed in claim 3, wherein the remote telephone control system includes a plurality of said contactors, the number of the contactors corresponding to the number of the electric devices to be controlled.

* * * * *